US005480495A

United States Patent [19]

Sakurada et al.

[11] Patent Number: 5,480,495

[45] Date of Patent: Jan. 2, 1996

[54] MAGNETIC MATERIAL

[75] Inventors: Shinya Sakurada; Takahiro Hirai, both of Yokohama; Akihiko Tsutai, Kawasaki; Masashi Sahashi, Yokohama, all of Japan

[73] Assignee: Kabushiki Kaisha Toshiba, Kawasaki, Japan

[21] Appl. No.: 86,379

[22] Filed: Jul. 6, 1993

Related U.S. Application Data

[63] Continuation of Ser. No. 858,014, Mar. 26, 1992, abandoned.

[30] Foreign Application Priority Data

Mar. 27, 1991 [JP] Japan ..... 3-063280
Dec. 18, 1991 [JP] Japan ..... 3-334968

[51] Int. Cl.[6] ..... H01F 1/055

[52] U.S. Cl. ..... 148/301; 148/315; 420/83; 420/117; 420/580; 420/581

[58] Field of Search ..... 148/301, 315; 420/83, 117, 580, 581

[56] References Cited

U.S. PATENT DOCUMENTS

| | | | |
|---|---|---|---|
| 4,710,242 | 12/1987 | Yamagishi et al. | 148/315 |
| 4,734,131 | 3/1988 | Arai et al. | 148/302 |
| 4,992,095 | 2/1991 | Nate et al. | 75/246 |
| 5,110,377 | 5/1992 | Yamamoto et al. | 148/302 |
| 5,135,584 | 8/1992 | Fujiwara | 148/301 |

FOREIGN PATENT DOCUMENTS

| | | | |
|---|---|---|---|
| 0344018 | 11/1989 | European Pat. Off. . | |
| 62-173704 | 7/1987 | Japan | 148/302 |
| 62-241302 | 10/1987 | Japan . | |
| 1175205 | 7/1989 | Japan . | |
| 316102 | 1/1991 | Japan . | |

OTHER PUBLICATIONS

Patent Abstracts of Japan, vol. 10, No. 150 (E–408)(2207), May 31, 1986, & JP–61 10 209, Jan. 17, 1986, Kouichirou Inomata, et al., "Permanent Magnet".

Patent Abstracts of Japan, vol. 11, No. 365 (C–460)(2812), Nov. 27, 1987, & JP–62 136 550, Jun. 19, 1987, Takeshi Anpo, et al., "Permanent Magnet Material".

Journal of Applied Physics, vol. 63, No. 8, Apr. 15, 1988, pp. 3130–3135, K. H. J. Buschow, "Structure and Properties of Some Novel Ternary FE–Rich Rare–Earth Intermetallics (Invited)".

Wohlfarth, "Ferromagnetic Materials", 1980 p. 390.

*Primary Examiner*—John P. Sheehan

*Attorney, Agent, or Firm*—Oblon, Spivak, McClelland, Maier, & Neustadt

[57] ABSTRACT

Disclosed is a magnetic material which suppresses formation of impurity phase of Fe, Co or Fe-Co alloy, possesses a stable $ThMn_{12}$ crystal structure as the principal phase, and is excellent in magnetic properties and lower in cost. Such magnetic material is expressed in a general formula:

$$R1_xR2_ySi_zM_uT_v$$

where R1 is at least one element selected from Zr and Hf, R2 is at least one element selected from rare earth element, M is at least one element selected from C, N and P, T is at least one element selected from Fe and Co, $x+y+z+u+v=100$, x, y, z, u, v are atomic percent individually defined as $0.1 \leqq x \leqq 20$, $2 \leqq y \leqq 20$, $0.5 \leqq z \leqq 20$, $0 \leqq u \leqq 20$, $v \geqq 50$, and of which principal phase possesses a $ThMn_{12}$ crystal structure.

24 Claims, 6 Drawing Sheets

MAGNETIC MATERIAL

This application is a continuation application Ser. No. 07/858,014, filed on Mar. 26, 1992, now abandoned.

BACKGROUND OF THE INVENTION

1. Field of the Invention

The present invention relates to a magnetic material useful for permanent magnet, bond magnet or other material.

2. Description of the Related Art

As high performance rare earth permanent magnets, hitherto, Sm-Co system magnet and Nd-Fe-B system magnet are known, and their mass production is promoted. These magnets contain Fe and Co at high rates, and they contribute to increase of saturation magnetization. These magnets also contain rare earth elements such as Nd and Sm, and the rare earth elements bring about a very large magnetic anisotropy derived from the behavior of 4f electrons in the crystal field. As a result, the coercive force is increased, and a magnet of high performance is realized. Such high performance magnets are mainly used in electric appliances such as loudspeaker, motor and instrument.

Recently, on the other hand, intermetallic compound having $ThMn_{12}$ crystal structure is noticed. This compound is small in the stoichiometric composition of rare earth elements with respect to 3d transition elements, as compared with that of intermetallic compounds belonging to Sm-Co magnet and Nd-Fe-B magnet such as $Sm_2Co_{17}$ and $Nd_2Fe_{14}B$, and contains large amount of 3d transition elements. It is therefore possible to realize a large saturation magnetization and high maximum energy product. Besides, this compound is small in the composition ratio of expensive rare earth element and may be manufactured at a low cost.

However, in the permanent magnet material composed iron-rich intermetallic compound is produced large amount of impurity phase mainly of α-Fe. Therefore, the permanent magnet is deteriorated the magnetic characteristic.

Besides, a magnetic material having a composition of introducing the intersticial elements such as N, C, P in the crystal lattice of the principal phase has been developed. This magnetic material is notably improved in the Curie temperature of the principal phase, saturation magnetization and magnetic anisotropy.

In the existing magnetic material introducing the intersticial elements in the principal phase, nevertheless, the thermal stability of the principal phase is poor, and, for example, $R_2Fe_{17}$ nitrogen compound begins to decompose into α-Fe and rare earth nitride (RN) at 600° C. $RFe_{11}Ti_1$ nitride having $ThMn_{12}$ structure begins to decompose at 450° C. Therefore, it is very difficult to form an intersticial element containing compound while suppressing the decomposition thereof, and a dense magnet cannot be formed by hot pressing or sintering heating higher than the decomposition temperature of the magnetic material.

SUMMARY OF THE INVENTION

It is an object of the present invention to provide a magnetic material which suppresses formation of impurity phase of Fe, Co or Fe-Co alloy, possesses a stable $ThMn_{12}$ crystal structure as the principal phase, and is excellent in magnetic properties and lowered in cost.

It is other object of the present invention to provide a magnetic material which suppresses formation of impurity phase of Fe, Co or Fe-Co alloy, possesses a $ThMn_{12}$ crystal structure introducing an intersticial element as the principal phase, and is excellent in magnetic properties, enhanced in the thermal stability of the $ThMn_{12}$ crystal structure, improved in magnetic properties such as Curie temperature, and lowered in cost.

It is another object of the present invention to provide a magnetic material which suppresses formation of impurity phase of Fe, Co or Fe-Co alloy, possesses a stable $TbCu_7$ crystal structure as the principal phase, and is excellent in magnetic properties and lowered in cost.

It is a different object of the present invention to provide a magnetic material Which suppresses formation of impurity phase of Fe, Co or Fe-Co alloy, possesses a $TbCu_7$ crystal structure introducing an intersticial element as the principal phase, and is excellent in magnetic properties, enhanced in the thermal structure of the $TbCu_7$ crystal structure, improved in magnetic properties such as Curie temperature, and lowered in cost.

To achieve the above objects, the present invention provides a magnetic material which is expressed in a general formula:

$$R1_xR2_ySi_zM_uT_v$$

where R1 is at least one element selected from Zr and Hf, R2 is at least one element selected from rare earth element, M is at least one element selected from C, N and P, T is at least one element selected from Fe and Co, $x+y+z+u+v=100$, x, y, z, u, v are atomic percent individually defined as $0.1 \leqq x \leqq 20$, $2 \leqq y \leqq 20$, $0.5 \leqq z \leqq 20$, $0 \leqq u \leqq 20$, $v \geqq 50$), and of which principal phase possesses a $ThMn_{12}$ crystal structure.

More specifically, the present invention provides a magnetic material which is expressed in a general formula:

$$R1_xR2ySi_zT_v$$

where R1 is at least one element selected from Zr and Hf, R2 is at least one element selected from rare earth element, T is at least one element selected from Fe and Co, $x+y+z+u+v=100$, x, y, z, v are atomic percent individually defined as $0.1 \leqq x \leqq 20$, $2 \leqq y \leqq 20$, $0.5 \leqq z \leqq 20$, $v \geqq 50$, and of which principal phase possesses a $ThMn_{12}$ crystal structure, and a magnetic material which is expressed in a general formula:

$$R1_xR2_ySi_zM_uT_v$$

where R1 is at least one element selected from Zr and Hf, R2 is at least one element selected from rare earth element, M is at least one element selected from C, N and P, T is at least one element selected from Fe and Co, $x+y+z+u+v=100$, x, y, z, u, v are atomic percent individually defined as $0.1 \leqq x \leqq 20$, $2 \leqq y \leqq 20$, $0.5 \leqq z \leqq 20$, $0 \leqq u$, $v \geqq 50$, and of which principal phase possesses a $ThMn_{12}$ crystal structure.

The principal phase herein denotes the phase occupying the maximum volume out of the crystal phases and non-crystal phases in the compound.

The components for composing the magnetic materials of the present invention are described individually in detail below.

(1) Element R1

The element R1 is used Zr, Hr, or a mixture of Zr and Hf. Such element R1 occupies the rare earth site of $ThMn_{12}$ crystal structure, and contributes to formation of this structure excellent in phase stability. The element R1 serves to improve the thermal stability of the compound if the element M (the intersticial element) is used as indespensable component.

If the element R1 is less than 0.1% by atom, much α-Fe is formed, and large coercive force is not obtained. If, on the other hand, the element R1 exceeds 20% by atom, the content of the element T (Fe, Co) becomes relatively small, and the saturation magnetization is extremely lowered. A more preferable content of the element R1 is in a range of 0.5 to 6% by atom.

(2) Element R2

Rare earth element as the element R2 is La, Ce, Pr, Nd, Pm, Sm, Eu, Gd, Tb, Dy, Ho, Er, Tm, Yb Lu, Y, which may be used either alone or in a mixture of two or more of these elements. The element R2 is an independensable component for formation of $ThMn_{12}$ crystal structure, and contributes to magnetic anisotropy.

Among these rare earth elements, in particular, Sm is useful for enhancing the magnetic properties. However, when the element M (an intersticial element) is added as an essential component, at least one of Pr and Nd among the rare earth elements is useful for enhancing the magnetic properties.

If the content of the element R2 is less than 2% by atom, it is difficult to form the $ThMn_{12}$ crystal structure. If, on the other hand, the element R2 exceeds 20% by atom, the content of the element T (Fe, Co) becomes relatively small, and the saturation magnetization is extremely lowered. A more preferable content of element R2 is in a range of 2 to 16% by atom.

Incidentally, the sum of the elements R1 and R2 is desired to be in a range of 4 to 20% by atom. By thus defining the total of the elements R1 and R2, it is possible to obtain a magnetic material possessing both excellent magnetic anisotropy and high coercive force. More preferably, the sum of the elements R1 and R2 is in a range of 6 to 16% by atom.

It is meanwhile allowed to replace a part of the element R2 by Ti. The replacing amount of Ti is limited to an extent not to adversely affect the magnetic properties of the magnetic material, for example, within 90% of the quantity of the element R1.

(3) Si

Si is an effective constituent element for forming a stable $ThMn_{12}$ phase. Si is also extremely effective for enhancing the thermal stability of the $ThMn_{12}$ phase containing the element M (the intersticial element).

The effect of Si is achieved by adding by 0.5% by atom or more, but when exceeding 20% by atom, the saturation magnetization is extremely lowered. A preferred content of Si is in a range of 0.5 to 15% by atom.

(4) Element T

The element T is at least one selected from Fe and Co. The effect of the element T is achieved when added by 50% by atom or more.

A part of the element T may be replaced by at least one type selected from Cr, V, Mo, W, Mn, Ni, Ga, Al, so that the rate of the $ThMn_{12}$ phase to the whole compound may be increased. However, if the element T is replaced too much by these elements, the magnetic flux density is lowered, and the replacing portion may be preferred 20% or less of the element T in percentage by atom.

(5) Element M

The element M is one or a mixture of at least two of C, N and P. By adding such element M, principally locating at the interstitial position of the $ThMn_{12}$ crystal structure, extending the crystal lattice as compared with the case not containing the element M, and varying the energy band structure, the Curie temperature, saturation magnetization, and magnetic anisotropy are enhanced.

If the content of element M exceeds 20% by atom, it is difficult to form $ThMn_{12}$ phase. To achieve the effect of addition of the element M, the lower limit is preferably set at 0.5% by atom.

The present invention also provides a magnetic material which is expressed in a general formula:

$$R1_xR2_ySi_zM_uT_v$$

where R1 is at least one element selected from Zr and Hf, R2 is at least one element selected from rare earth element, M is at least one element selected from C, N and P, T is at least one element selected from Fe and Co, $x+y+z+u+v=100$, x, y, z, u, v are atomic percent individually defined as $0.1 \leqq x \leqq 20$, $2 \leqq y \leqq 20$, $0.5 \leqq z \leqq 20$, $0 \leqq u \leqq 20$, $v \geqq 50$, and of which principal phase possesses a $TbCu_7$ crystal structure.

More specifically, the present invention provides a magnetic material which is expressed in a general formula:

$$R1_xR2_ySi_zT_v$$

where R1 is at least one element selected from Zr and Hf, R2 is at least one element selected from rare earth element, T is at least one element selected from Fe and Co, $x+y+z+v=100$, x, y, z, v are atomic percent individually defined as $0.1 \leqq x \leqq 20$, $2 \leqq y \leqq 20$, $0.5 \leqq z \leqq 20$, $v \geqq 50$, and of which principal phase possesses a $TbCu_7$ crystal structure, and a magnetic material which is expressed in a general formula:

$$R1_xR2_ySi_zM_uT_v$$

where R1 is at least one element selected from Zr and Hf, R2 is at least one element selected from rare earth element, M is at least one element selected from C, N and P, T is at least one element selected from Fe and Co, $x+y+z+u+v=100$, x, y, z, u, v are atomic percent individually defined as $0.1 \leqq x \leqq 20$, $2 \leqq y \leqq 20$, $0.5 \leqq z \leqq 20$, $0<u$, $v \geqq 50$, and of which principal phase possesses a $TbCu_7$ crystal structure.

The principal phase herein denotes the phase occupying the maximum volume out of the crystal phases and non-crystal phases in the compound.

The components for composing the magnetic materials of the invention of which principal phase possesses the $TbCu_7$ crystal structure are described in detail below.

The element R1 and the element R2 are added in expectation of the same actions as mentioned above. As for the element R2, selection of Sm is useful for enhancing the magnetic properties. However, when the element M (the intersticial element) is added as an essential component, it is useful for enhancing the magnetic properties to use at least one of Pr, Nd and Sm among the R2 elements.

Si is an effective element for forming a stable $TbCu_7$ phase. Si is also extremely effective for enhancing the thermal stability of the $TbCu_7$ phase containing the element M (the intersticial element). The content of such Si is limited owing to the same reason as mentioned above.

The element T is one selected from Fe and Co, but a part of the element T may be replaced at least one of Cr, v, Mo, W, Mn, Ni, Ga, Al.

The element M is principally located at the interstitial position of the $TbCu_7$ crystal structure mainly, and its addition is limited owing to the same reason as above.

A manufacturing method of magnetic material of the present invention is described below.

In the first place, an alloy powder is prepared in the following method.

(1) An alloy powder is prepared by using specified contents of the elements R1, R2, Si, T, and adding the element M as required. In this case, the material powder is melted by arc melting or induction melting, and cast to prepare an alloy in desired composition, and the obtained alloy is crushed.

(2) The mixture of the elements R1, R2, Si, T, and also element M as required may be alloyed by applying a mechanical energy, in the mechanical alloying method or mechanical grinding method. These methods are the procedure for alloying by solid-phase reaction of the mixture of powder or ingot containing the elements R1, R2, Si, T. Practical methods for inducing the solid-phase reaction includes the method of applying a mechanical impact to the powder by charging the material mixture into the planet ball mill, rotary ball mill, attriter, vibration ball mill, screw ball mill or the like. By these methods, the material powder is crushed to thin pieces, and different atoms diffuse mutually on the mutually contacting positions of the thin pieces, so that the material mixture is homogeneously unified.

(3) The alloy powder in the desired composition is prepared by liquid quenching method.

According to the results of experiment conducted by the present inventors, the $ThMn_{12}$ phase is likely to become the principal phase in the alloy obtained by melting by arc melting or induction melting process.

Besides, in the alloy powder prepared by heat treatment after mechanical alloying method or mechanical grinding method, the $TbCu_7$ phase is likely to be the principal phase.

Furthermore, in the alloy powder prepared by liquid quenching method, the principal phase may be either $ThMn_{12}$ phase or $TbCu_7$ phase depending on the cooling rate or composition. For example, when Si is contained by 15% by atom in the alloy, if the cooling rate is slow, the $ThMn_{12}$ phase becomes the principal phase, and if fast, there is a compound in which the $TbCu_7$ phase is the principal phase. At a constant cooling rate, in the alloy containing Si by 15% by atom, the $ThMn_{12}$ phase is the principal phase, or in the alloy with 8% by atom, there exists a compound in which $TbCu_7$ phase is the principal phase.

The obtained alloy powder is heated in inert gas atmosphere or vacuum at 300° to 1000° C. for 0.1 to 100 hours, and the coercive force is improved greatly. This heat treatment may be omitted, however, if nitriding in the case of manufacture of, for example, magnetic material containing nitrogen as element M as mentioned later. Furthermore, the heat treatment may be also omitted when hot pressing or hot plastic processing is conducted for obtaining a permanent magnet as mentioned later.

Explained next are manufacturing methods of a magnetic material containing nitrogen as element M.

In a first method, nitrogen used as element M is introduced into the alloy powder by heating the alloy powder in a nitrogen gas atmosphere at 0.001 to 2 atmospheric pressures for 0.1 to 100 hours at 300 to 800° C.

The atmosphere for nitriding may be, instead of nitrogen gas, nitrogen compound gas such as ammonia. The partial pressure of nitrogen or nitrogen compound or its mixture gas may be preferably set in a range of 0.001 to 2 atmospheric pressures.

In nitriding treatment, it is also possible to mix other gas not containing nitrogen, aside from nitrogen and nitrogen compound gas. When mixing oxygen, however, it is desired to set the partial pressure of oxygen at 0.02 atmospheric pressure or less in order to avoid deterioration of magnetic properties due to formation of oxide during heat treatment.

The nitriding treatment may be also conducted after heat treatment employed for improving the coercive force.

In a second method, nitrogen used as the element M is introduced into the alloy powder by inducing solid phase reaction, using the nitride such as SiN and RN as the material in the process of preparation of the alloy powder.

From the alloy powder (magnetic material) relating to the invention obtained in the above methods, the following permanent magnet and bond magnet can be manufactured.

(a) A permanent magnet is manufactured by forming the alloy powder in a unified form of high density (compressed powder) by hot press or hot immersion press (HIP). Here, by applying a magnetic field to the formed body to align the crystal orientation, a magnet having a high magnetic flux density may be obtained. Moreover, after hot press or HIP, by plastic deformation processing while pressurizing at a temperature of 300° to 700° C., the magnetic orientation may be obtained in the axis easy to magnetize.

(b) The alloy powder is bonded by using a metallic binder composed of metal such as Al, Pb, Sn, Zn, Mg or alloy, and a permanent magnet is produced.

(c) A permanent magnetic is manufactured by sintering the alloy powder.

(d) The alloy powder is mixed with resin such as epoxy resin and nylon, and formed to produce a bond magnet. When using the epoxy resin thermoset resin, it is preferred to cure at a temperature of 100° to 200° C. after compressive forming. When using the nylon thermoplastic resin, it is desired to employ the injection forming method.

According to the material of the present invention, formation of impurity phase of Fe, Co or Fe-Co alloy is suppressed, and a stable $ThMn_{12}$ crystal structure is formed as the principal phase, and therefore excellent magnetic properties are exhibited, and a lower cost is realized.

That is, in the rare earth iron intermetallic compound, the stable formation of $ThMn_{12}$ phase as principal phase depends greatly on the atomic radius of the element in the rare earth site. More specifically, by reducing the atomic radius of the element occupying the rare earth site, a stable $ThMn_{12}$ phase may be formed. To the contrary, when the atomic radius of the element occupying the rare earth site exceeds 1.84 A, stable $ThMn_{12}$ phase cannot be formed.

In the rare earth element, as the atomic weight is larger, the atomic radius becomes smaller due to lanthanide contraction. For example, in the case of a rare earth iron intermetallic compound using a light rare earth element of a smaller atomic weight than Sm, that is, a larger atomic radius than Sm, the formation of impurity phase mainly of α-Fe is dominant, and therefore the rare earth iron intermetallic compound having the $ThMn_{12}$ phase as the principal phase cannot be obtained.

On the other hand, even in the light rare earth element of large atomic radius, by mixing with a light rare earth element of a larger atomic weight, i.e. a light rare earth element or heavy rare earth element of smaller atomic radius, the average atomic radius of the entire rare earth element in the rare earth site can be reduced. As a result, a stable $ThMn_{12}$ phase can be formed. However, such rare earth iron intermetallic compound in $ThMn_{12}$ crystal structure is limited by the combination of specific rare earth elements. Hence, the magnetic properties may be sacrificed by the combination of rare earth elements.

The present invention, as indicated by the combination expressed in the general formula $R1_xR2_ySi_zT_v$, can suppress the formation of impurity phase of Fe, Co or Fe-Co alloy by replacing a part of the rare earth element of R2 by Zr or Hf of R1, so that magnetic material having a stably formed $ThMn_{12}$ crystal structure as the principal phase may be obtained. That is, since Zr and Hf are smaller in atomic radius as compared with rare earth elements, by mixing Zr or Hf in the rare earth element, the atomic radius of the elements occupying the rare earth site can be controlled in a wide range. As a result, without being restricted by at least one element selected from rare earth element, by combining with various rare earth elements Zr, and Hf, it is possible to form a stable $ThMn_{12}$ crystal structure as the principal phase.

Therefore, a magnetic material having a stable $ThMn_{12}$ crystal structure as the principal phase and excellent in magnetic properties can be obtained. By using element T (Fe, Co) as a part of the composition, and replacing a part of the rare earth element by Zr or Hf as R1, the use of the expensive rare earth element may be greatly saved. Hence, the magnetic material of low cost is obtained.

With other magnetic material of the invention, formation of impurity phase of Fe, Co or Fe-Co alloy is suppressed, and a $ThMn_{12}$ crystal structure introducing the intersticial element is formed as the principal phase for enhancing the magnetic properties, and the thermal stability of the $ThMn_{12}$ crystal structure is enhanced, the Curie temperature is improved, and the cost is lowered.

To form a stable $ThMn_{12}$ crystal structure in a rare earth iron intermetallic compound, it is necessary to replace a small fraction of Fe by the elements such as Si, Cr, V, Ti, Mo, W, Mn, Ga, Al.

On the other hand, the $Th_2Zn_{17}$ crystal structure and $Th_2Ni_{17}$ crystal structure may be also formed in rare earth iron binary system. By introducing the intersticial elements such as N and C in the crystal lattice of these $Th_2Zn_{17}$ phase and $Th_2Ni_{17}$ phase, it is known effective to enhance the magnetic properties. In the $ThMn_{12}$ crystal structure, when Ti, V or Mo is used as stabilizing elements, it is known that the effect by the intersticial elements is recognized.

The present invention, having the composition expressed in the general formula $R1_xR2_ySi_zM_uT_v$, is capable of producing a magnetic material suppressed in the formation of impurity phase of Fe, Co or Fe-Co alloy as mentioned above.

Moreover, as shown in the general formula, by possessing the $ThMn_{12}$ crystal structure introducing the intersticial elements as the principal phase, the Curie temperature is improved, and a magnetic material having excellent magnetic properties may be obtained. Furthermore, by adding Si as stabilizing element, the thermal instability of the $ThMn_{12}$ crystal structure due to introduction of the intersticial element M can be eliminated. In particular, the magnetic material of the invention is extremely excellent in thermal stability as compared with the case of containing Ti, V, Mo in the specified crystal structure phase in which the intersticial element is introduced mentioned above. By such improvement of thermal stability, the compound containing the intersticial element be formed more easily, and hot press can be applied. By using the denser compressed powder prepared the hot press, a permanent magnet excellent in magnetic properties is obtained. The element R1 serves also to improve the thermal stability of the $ThMn_{12}$ crystal structure which is introduced the intersticial element.

In a different magnetic material of the invention, having the composition expressed by a general formula $R1_xR2_ySi_zT_v$, formation of impurity phase of Fe, Co or Fe-Co alloy is suppressed, and a stable $TbCu_7$ crystal structure is formed as the principal phase, and therefore excellent magnetic properties can be exhibited, and the cost may be lowered.

In a further different magnetic material of the present invention, having the composition expressed in a general formula $R1_xR2_ySi_zM_uT_v$, formation of impurity phase of Fe, Co or Fe-Co alloy is suppressed, and a $TbCu_7$ crystal structure introducing the intersticial elements is formed as the principal phase to enhance the magnetic properties, and the thermal stability of the $TbCu_7$ crystal structure is enhanced, and the Curie temperature is improved, and the cost is lowered. Hence, same as the magnetic material having the $ThMn_{12}$ crystal structure, hot pressing at high temperature is possible, and using a denser compressed powder, a permanent magnet excellent in magnetic properties may be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Some of the preferred embodiments of the invention are described in detail below.

EMBODIMENT 1

High purity Zr, Nd, Si and Fe were blended at atomic fractions of 2 atm % of Zr, 6 atm % of Nd, 16 atm % of Si, and the balance of Fe. This mixed material was melted in arc in Ar atmosphere to obtain an ingot. Small pieces of the ingot were inserted into a quartz tube with a nozzle (0.8 mm in diameter), and is located in vertical position, and the ingot was melted by high frequency induction heating in Ar atmosphere. Afterward, Ar gas was supplied at a pressure of about 300 torr to the upper side of the quartz tube, and the molten alloy in the quartz tube was injected to a copper roll rotating fast at a peripheral speed of 10 m/s from the nozzle to be quenched, and a rapid quenching ribbon was obtained.

EMBODIMENTS 2 to 11

Ten rapid quenching ribbons were obtained by treating the materials in the composition as shown in Table 1 in the same manner as in Embodiment 1.

CONTROL 1

The raw material blending high purity Nd, Si, and Fe at atomic fractions of 8 atm % of Nd, 16 atm % of Si, and the balance of Fe was treated in the same manner as in Embodiment 1, and a rapid quenching ribbon was obtained.

The crystal structures of the obtained ribbons of Embodiment 1 to 11 were measured by the X-ray diffraction method. The results are shown in Table 1.

TABLE 1

| | Alloy composition (bal denotes balance) | X-ray main peak intensity ratio of $ThMn_{12}$ phase |
|---|---|---|
| Embodiment 1 | $Zr_2Nd_6Si_{16}Fe$ (bal) | 75% |
| Embodiment 2 | $Zr_2Nd_4Pr_2Si_{16}Fe$ (bal) | 76% |
| Embodiment 3 | $Zr_2Sm_8Si_{14}Cr_2Fe$ (bal) | 91% |
| Embodiment 4 | $Zr_2Sm_6Nd_2Si_{14}V_2Fe$ (bal) | 84% |
| Embodiment 5 | $Zr_2Hf_2Sm_6Si_{14}Al_2Fe$ (bal) | 88% |
| Embodiment 6 | $Zr_6Nd_2Si_{16}Fe$ (bal) | 90% |
| Embodiment 7 | $Zr_4Nd_4Si_{16}Fe$ (bal) | 82% |
| Embodiment 8 | $Zr_2Sm_4Tb_2Si_{16}Mo_4Fe$ (bal) | 92% |
| Embodiment 9 | $Zr_2Sm_4Dy_2Si_{16}Mn_2Fe$ (bal) | 90% |
| Embodiment 10 | $Zr_1Sm_4Er_4Si_{16}W_1Fe$ (bal) | 91% |
| Embodiment 11 | $Zr_1Hf_1Sm_6Ho_2Si_{16}Fe$ (bal) | 93% |

Moreover, in the ribbons obtained in Embodiment 1 and Control 1, X-ray diffraction patterns were obtained by using CuKa radiation. The results are shown in FIG. 1 and FIG. 2, respectively.

Figure 1:
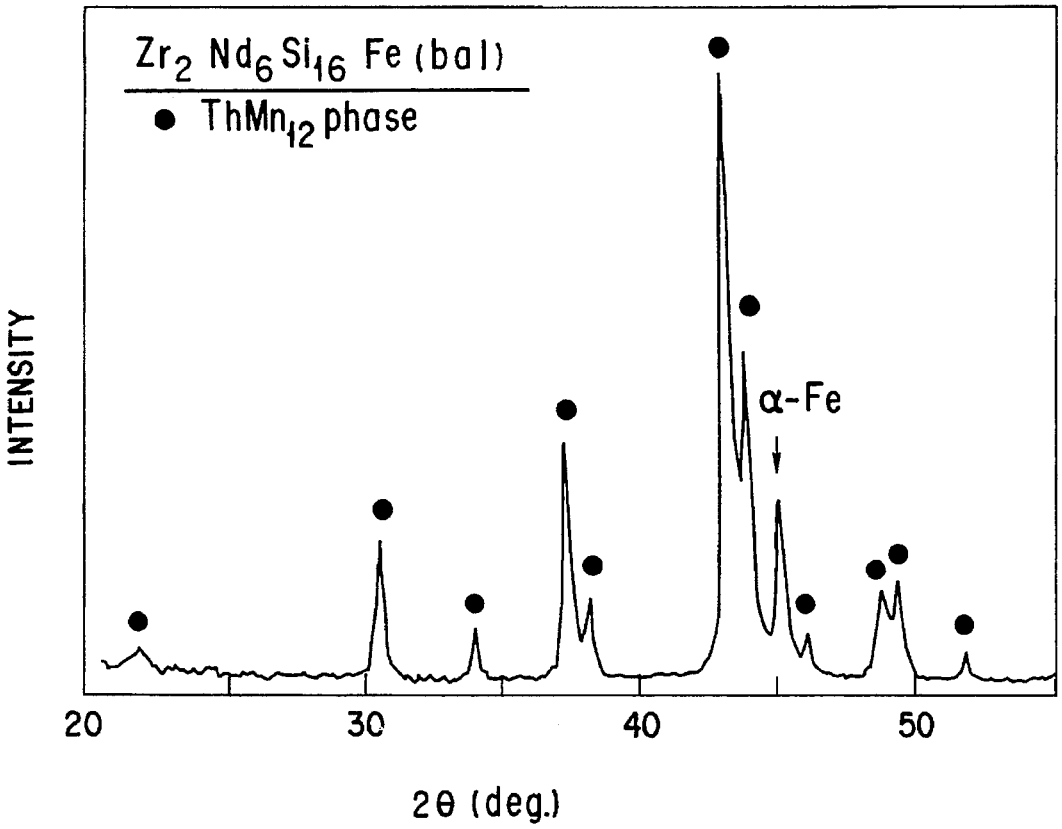
FIG. 1 is a diagram showing an X-ray diffraction pattern of a magnetic material in Embodiment 1 of the invention.
Figure 2:
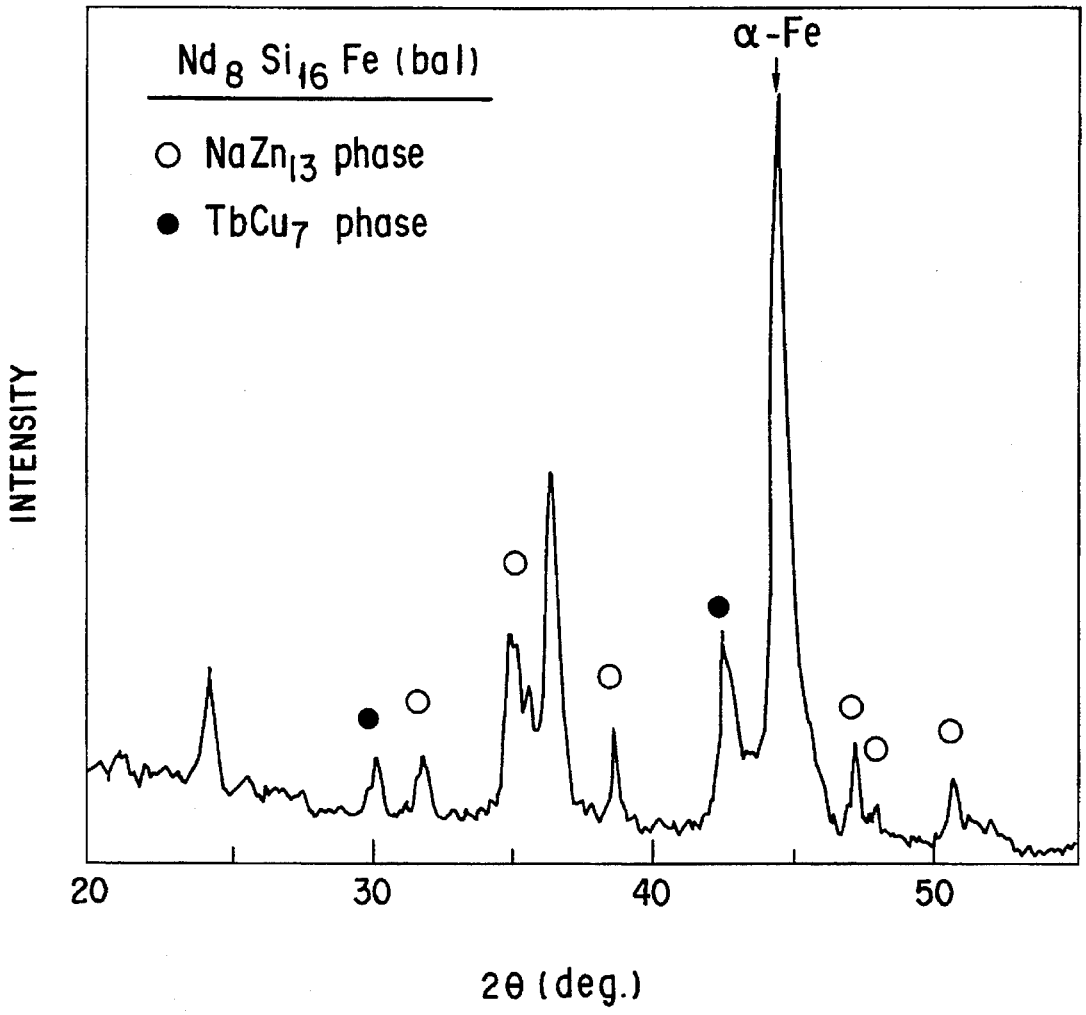
FIG. 2 is a diagram showing an X-ray diffraction pattern of a magnetic material in Control 1.

As clear from Table 1 and FIG. 1, it is known that the $ThMn_{12}$ phase is formed as the principal phase in the ribbons of Embodiments 1 to 11. By contrast, in the ribbon of Control 1 which is similar in composition to Embodiment 1 except that Zr is not added, as known from FIG. 2, α-Fe is formed, and $ThMn_{12}$ phase is not formed at all.

EMBODIMENT 12

High purity Zr, Sm, Si and Fe were blended at atomic fractions of 0.5 atm % of Zr, 8 atm % of Sm, 16 atm % of Si and the balance of Fe. This mixed material was melted in arc in Ar atmosphere to obtain an ingot. Small pieces of the ingot were inserted into a quarts tube with a nozzle (0.8 mm in diameter), and is located in vertical position, was melted by high frequency induction heating in Ar atmosphere. Afterwards, supplying Ar gas at a pressure of about 300 torr to the upper side of the quartz tube, the molten alloy in the quartz tube was injected to a copper roll rotating fast at a peripheral speed of 30 m/s from the nozzle to be quenched, and a rapid quenching ribbon was obtained.

The crystal structure of the obtained ribbon was measured by X-ray diffraction method. As a result, the principal phase was $ThMn_{12}$ phase.

After heating this ribbon in vacuum for 10 minutes at 800° C., its magnetic properties were measured. As a result, the remanence was 5.6 kG, and the coercive force was 3.6 kOe, and extremely excellent magnetic properties were confirmed.

EMBODIMENT 13

High purity Zr, Nd, Si and Fe were blended at atomic fractions of 4 atm % of Zr, 4 atm % of Nd, 4 atm % of Si, and the balance of Fe. This mixed material was melted in arc in Ar atmosphere to obtain an ingot. Small pieces of the ingot were inserted into a quarts tube with a nozzle (0.8 mm in diameter), and is located in vertical position, and the ingot was melted by high frequency induction heating in Ar atmosphere. Afterwards, Ar gas was supplied at a pressure of about 300 torr to the upper side of the quartz tube, and the molten alloy in the quartz tube is injected to a copper roll rotating fast at a peripheral speed of 30 m/s from the nozzle to be quenched, and a rapid quenching ribbon was obtained.

EMBODIMENTS 14 to 22

Nine ribbons were obtained by treating the materials in the compositions shown in Table 2 in the same manner as in Embodiment 13.

The crystal structures of the obtained ribbons of Embodiments 13 to 22 were measured by the X-ray diffraction method. The results are shown in Table 2.

TABLE 2

| | Alloy composition (bal denotes balance) | X-ray main peak intensity ratio of $TbCu_7$ phase |
|---|---|---|
| Embodiment 13 | $Zr_4Nd_4Si_4Fe$ (bal) | 80% |
| Embodiment 14 | $Zr_4Nd_4Si_8Fe$ (bal) | 76% |
| Embodiment 15 | $Zr_2Sm_6Si_8Fe$ (bal) | 72% |
| Embodiment 16 | $Zr_4Nd_4Si_{16}Fe$ (bal) | 70% |
| Embodiment 17 | $Zr_3Nd_4Pr_2Si_8Fe$ (bal) | 69% |
| Embodiment 18 | $Zr_2Hf_1Sm_6Er_2Si_8Fe$ (bal) | 80% |
| Embodiment 19 | $Zr_3Sm_6Tb_1Si_8Co_{10}Fe$ (bal) | 76% |
| Embodiment 20 | $Zr_3Nd_4Dy_2Si_8Mo_2Fe$ (bal) | 72% |
| Embodiment 21 | $Zr_3Nd_4Ho_2Si_8Mn_2Fe$ (bal) | 73% |
| Embodiment 22 | $Zr_3Nd_4Sm_2Si_8W_1Fe$ (bal) | 74% |

In the ribbon obtained in Embodiment 13, the X-ray diffraction pattern was determined by using CuKa radiation. The result is shown in FIG. 3.

Figure 3:
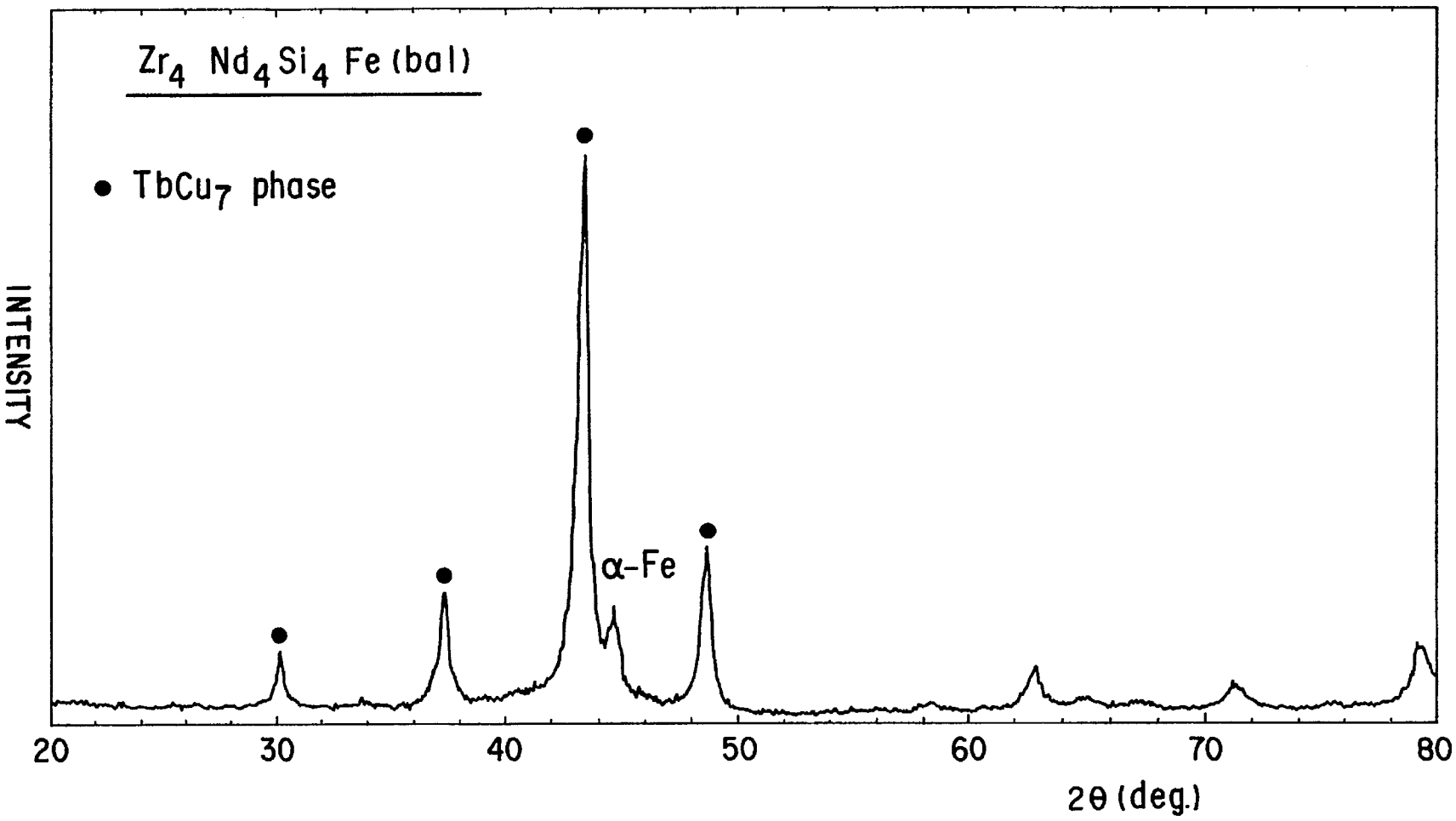
FIG. 3 is a diagram showing an X-ray diffraction pattern of a magnetic material in Embodiment 13 of the invention.

As clear from Table 2 and FIG. 3, in the ribbons of Embodiments 13 to 22, the $TbCu_7$ phase was present as the principal phase.

EMBODIMENTS 23 to 27

High purity powders of Nd, Sm, Pr, Zr, Hf, Ti, Mo, Si, W, Ga, C, Fe, Co were blended as prescribed, and melted in arc in Ar atmosphere, and poured into a mold, and five ingots were prepared. The ingots were ground to mean particle size of 50 to 100 μm by using a mortar, and heated for 2 hours at temperature of 500° to 700° C. in nitrogen gas atmosphere of one atmospheric pressure, respectively. The compositions of the specimens after heat treatment are shown in Table 3. The heat treatment temperature in nitrogen atmosphere is also shown in Table 3.

The crystal structures of the obtained specimens of Embodiments 23 to 27 were measured by the X-ray diffraction method. The results are also shown in Table 3.

TABLE 3

| | Alloy composition (bal denotes balance) | Heat treatment temperature in nitrogen atmosphere | X-ray main peak intensity ratio of $ThMn_{12}$ phase |
|---|---|---|---|
| Embodiment 23 | $Zr_4Nd_4Si_{15}N_4Fe$ (bal) | 620° C. | 80% |
| Embodiment 24 | $Zr_3Hf_2Nd_6Si_{10}W_1Ga_1N_2CO_2Fe$ (bal) | 620° C. | 75% |
| Embodiment 25 | $Zr_2Sm_2Pr_1Nd_5Si_{10}C_2N_6Co_8Fe$ (bal) | 600° C. | 77% |
| Embodiment 26 | $Zr_4Nd_8Pr_1Si_{10}Mo_5C_1N_7Co_5Fe$ (bal) | 640° C. | 77% |
| Embodiment 27 | $Hf_2Sm_2Nd_2Ti_2Si_{12}Mo_2N_8Co_7Fe$ (bal) | 600° C. | 79% |

In the obtained specimen of Embodiment 23, the X-ray diffraction pattern was determined by using CuKα radiation. The result is shown in FIG. 4.

Figure 4:
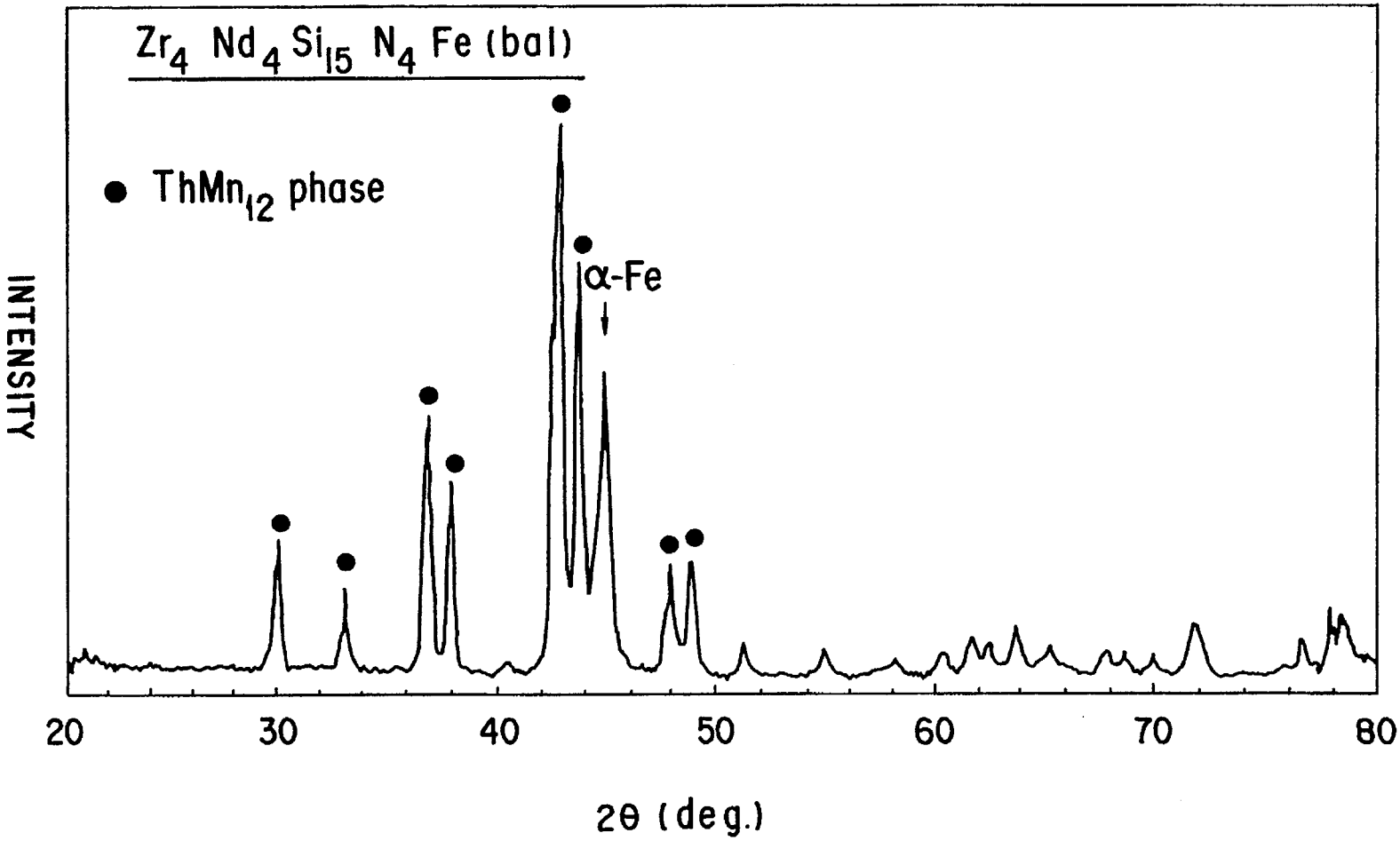
FIG. 4 is a diagram showing an X-ray diffraction pattern of a magnetic material in Embodiment 23 of the invention.

As evident from Table 3 and FIG. 4, in all specimens of Embodiments 23 to 27, the $ThMn_{12}$ phase is formed as the principal phase.

Furthermore, the specimens of Embodiments 23 to 27 were molded in magnetic field using Zn powder as binder, and heated in Ar atmosphere at 300° to 600° C. to fabricate permanent magnets. Then, the permanent magnets were measured the coercive force and the saturation magnetization. As a result, these permanent magnets were confirmed to have excellent magnetic properties, with the saturation magnetization, 4πMs of 0.4 to 0.5 T, and the coercive force, iHc of 4000 to 6000 Oe.

EMBODIMENTS 28 to 32

Powders of Sm, Pr, Nd, Er, Zr, Hf having an average particle size of 0.5 mm, and powders of Fe, Co, Cr, V, Si, Ti having an average particle size of 3 to 40 μm were blended as prescribed to prepared five mixed powders. The mixed powders were put in ball mill, and ground and mixed for 65 hours in Ar atmosphere, and were alloyed by mechanical alloying. Forming dies were filled with alloy powders, and heated for 2 hours at 500° to 700° C. in nitrogen gas atmosphere at one atmospheric pressure. The compositions of specimens after heat treatment are shown in Table 4. The heat treatment temperature in nitrogen atmosphere is also shown in Table 4.

The crystal structures of the obtained specimens in Embodiments 28 to 32 were measured by X-ray diffraction method. The results are also shown in Table 4.

TABLE 4

| | Alloy composition (bal denotes balance) | Heat treatment temperature in nitrogen atmosphere | X-ray main peak intensity ratio of $TbCu_7$ phase |
|---|---|---|---|
| Embodiment 28 | $Nd_4Zr_4Si_8N_{12}Fe$ (bal) | 520° C. | 69% |
| Embodiment 29 | $Sm_3Pr_3Nd_3Hf_2V_1Si_9N_8Fe$ (bal) | 580° C. | 71% |
| Embodiment 30 | $Pr_2Nd_5Zr_5Ti_3P_1Si_9N_6Fe$ (bal) | 530° C. | 69% |
| Embodiment 31 | $Sm_2Nd_3Zr_2Cr_3C_2Si_7N_7Co_2Fe$ (bal) | 600° C. | 72% |
| Embodiment 32 | $Sm_7Nd_7Er_1Zr_2Si_{10}N_5Fe$ (bal) | 590° C. | 70% |

In the obtained specimen of Embodiment 28, X-ray diffraction pattern was determined by using CuKa radiation. The result is shown in FIG. 5.

Figure 5:
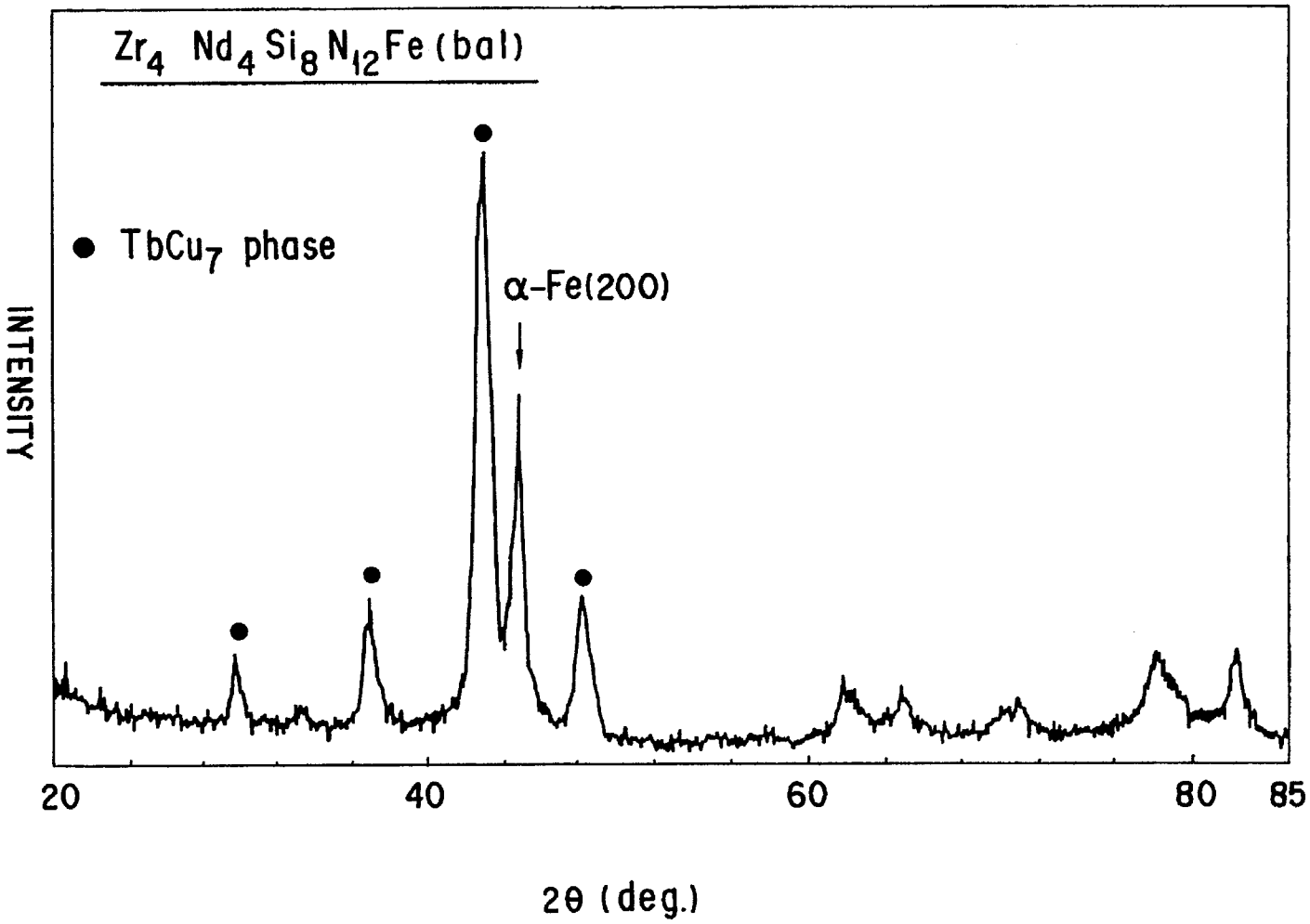
FIG. 5 is a diagram showing an X-ray diffraction pattern of a magnetic material in Embodiment 28 of the invention.

As clear from Table 4 and FIG. 5, in the specimens of Embodiments 28 to 32, the $TbCu_7$ phase is present as the principal phase.

Moreover, from the specimens of Embodiments 28 to 32, permanent magnets were prepared in the same manner as in Embodiment 23, and the coercive force and the saturation magnetization were measured. As a result, in all these permanent magnets, the saturation magnetization, 4πMs was 0.4 to 0.5 T, and the coercive force, iHc was 4000 to 6000 Oe, and excellent magnetic properties were confirmed.

CONTROLS 2 to 4

High purity powders of Nd, Sm, Zr, Ti, Mo, Fe and Co were blended in the composition as shown in Table 5, and melted in arc in Ar atmosphere, and poured into molds to prepare three ingots. The ingots were ground in an average particle size of 50 to 100 μm same as in Embodiment 23, and heated for 2 hours at 500° to 700° C. in nitrogen gas atmosphere of one atmospheric pressure. The heat treatment temperature in nitrogen atmosphere is also shown in Table 5.

TABLE 5

| | Alloy composition (bal denotes balance) | Heat treatment temperature in nitrogen atmosphere |
|---|---|---|
| Control 2 | $Sm_8Ti_8Fe$ (bal) | 600° C. |
| Control 3 | $Sm_5Nd_3Mo_8Co_8Fe$ (bal) | 620° C. |
| Control 4 | $Sm_6Zr_1Ti_9Fe$ (bal) | 580° C. |

In the obtained specimen of Control 2, the x-ray diffraction pattern was determined by using CuKα radiation. The results are shown in FIG. 6.

Figure 6:
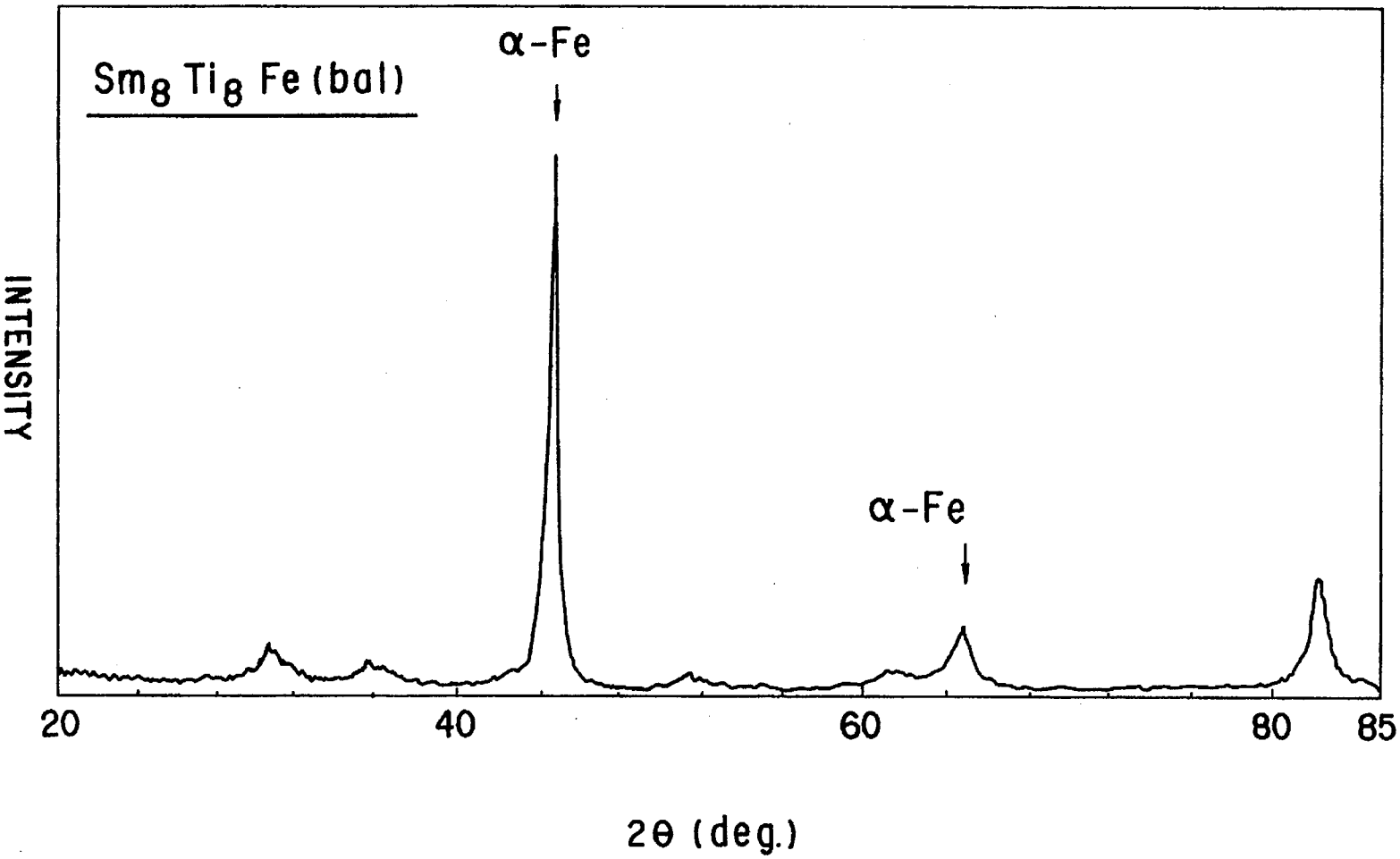
FIG. 6 is a diagram showing an X-ray diffraction pattern of a magnetic material in Control 2.

As clear from FIG. 6, in the specimen of Control 2, α-Fe massively precipitates into the compound. This is because the thermal stability of the nitride is poor because Si is not contained in the composition, and decomposition occurs at the heat treatment temperature in Table 6. Meanwhile, as a result of determining the X-ray diffraction pattern by using CuKα ray in the specimens of Controls 3, 4, the same X-ray diffraction pattern as in FIG. 6 (X-ray diffraction pattern of Reference 2) was shown.

According to the present invention, as described herein, it is possible to provide a magnetic material of low cost effective as the material for permanent magnet, bond magnet or the like to be processed by hot press or the like, which suppresses the formation of impurity phase of Fe, Co or Fe-Co alloy, possesses stable $ThMn_{12}$ crystal structure or $TbCu_7$ crystal structure as the principal phase, and is characterized by excellent magnetic properties such as saturation magnetization and the coercive force.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A magnetic material which consists essentially of a general formula:

$$R1_xR2_ySi_zM_uT_v$$

where R1 is at least one element selected from Zr and Hf, R2 is at least one element selected from the rare earth elements, M is at least one element selected from C, N and P, T is one material selected from Fe and combinations of Fe and Co, $x+y+z+u+v=100$, x, y, z, u, v, are atomic percent individually defined as $0.1 \leqq x \leqq 20$, $2 \leqq y \leqq 20$, $0.5 \leqq z \leqq 20$, $0 \leqq u \leqq 20, v \geqq 50$, wherein the Fe content of said magnetic material is at least 63 atomic percent; and of which the principal phase possesses a $TbCu_7$ crystal structure.

2. A magnetic material of claim 1, wherein R1 in the general formula is Zr.

3. A magnetic material of claim 1, wherein R2 in the general formula is Sm.

4. A magnetic material of claim 1, wherein x and y in the general formula are $4 \leqq x+y \leqq 20$.

5. A magnetic material of claim 1, wherein x in the general formula is $0.5 \leqq x \leqq 6$.

6. A magnetic material of claim 1, wherein y in the general formula is $2 \leqq y \leqq 15$.

7. A magnetic material of claim 1, wherein z in the general formula is $0.5 \leqq z \leqq 15$.

8. A magnetic material of claim 1, wherein T in the general formula is Fe.

9. A magnetic material of claim 1, wherein u in the general formula is $u > 0$.

10. A magnetic material of claim 9, wherein R1 in the general formula is Zr, and R2 is at least one element selected from Pr and Nd.

11. A magnetic material which consists essentially of a general formula:

$$R1_xR2_ySi_zM_uT_v$$

where R1 is at least one element selected from Zr and Hf, R2 is at least one element selected from the rare earth elements, M is at least one element selected from C, N and P, T is one material selected from Fe and combinations of Fe and Co, $x+y+z+u+v=100$, x, y, z, u, v, are atomic percent individually defined as $0.1 \leqq x \leqq 20$, $2 \leqq y \leqq 20$, $0.5 \leqq z \leqq 20$, $0 \leqq u \leqq 20, v \geqq 50$, wherein the Fe content of said magnetic material is at least 68 atomic percent; and of which the principal phase possesses a $TbCu_7$ crystal structure.

12. A magnetic material of claim 11, wherein R1 in the general formula is Zr.

13. A magnetic material of claim 11, wherein R2 in the general formula is Sm.

14. A magnetic material of claim 11, wherein x and y in the general formula are $4 \leqq x+y \leqq 20$.

15. A magnetic material of claim 11, wherein x in the general formula is $0.5 \leqq x \leqq 6$.

16. A magnetic material of claim 11, wherein y in the general formula is $2 \leqq y \leqq 15$.

17. A magnetic material of claim 11, wherein z in the general formula is $0.5 \leqq z \leqq 15$.

18. A magnetic material of claim 11, wherein T in the general formula is Fe.

19. A magnetic material of claim 11, wherein u in the general formula is $u > 0$.

20. A magnetic material of claim 19, wherein R1 in the general formula is Zr, and R2 is at least one element selected from Pr, Nd and Sm.

21. A magnetic material according to claim 1, wherein T in the general formula contains Co in an amount of not more than 10 atomic percent.

22. A magnetic material according to claim 9, wherein M in the general formula is at least one element selected from N and C.

23. A magnetic material according to claim 11, wherein T in the general formula contains Co in an amount of not more than 10 atomic percent.

24. A magnetic material according to claim 19, wherein M in the general formula is at least one element selected from N and C.

* * * * *